US011141745B2

(12) United States Patent
Moeschl et al.

(10) Patent No.: US 11,141,745 B2
(45) Date of Patent: Oct. 12, 2021

(54) CLEANING DEVICE AND PRODUCT PROCESSING SYSTEM

(71) Applicant: NETZSCH-Feinmahltechnik GmbH, Selb (DE)

(72) Inventors: Holger Moeschl, Selb (DE); Witali Sudermann, Marktredwitz (DE)

(73) Assignee: NETZSCH-Feinmahltechnik GmbH, Selb (DE)

( * ) Notice: Subject to any disclaimer, the term of this patent is extended or adjusted under 35 U.S.C. 154(b) by 869 days.

(21) Appl. No.: 15/751,810

(22) PCT Filed: Jul. 29, 2016

(86) PCT No.: PCT/DE2016/000297
§ 371 (c)(1),
(2) Date: Feb. 9, 2018

(87) PCT Pub. No.: WO2017/028831
PCT Pub. Date: Feb. 23, 2017

(65) Prior Publication Data

US 2018/0236467 A1 Aug. 23, 2018

(30) Foreign Application Priority Data

Aug. 17, 2015 (DE) ..... 102015113559.0
Feb. 17, 2016 (DE) ..... 102016102727.8

(51) Int. Cl.
*B05B 3/04* (2006.01)
*B08B 9/093* (2006.01)
*B05B 3/06* (2006.01)

(52) U.S. Cl.
CPC ..... *B05B 3/0445* (2013.01); *B08B 9/0936* (2013.01); *B05B 3/066* (2013.01)

(58) Field of Classification Search
None
See application file for complete search history.

(56) References Cited

U.S. PATENT DOCUMENTS 1,352,423 A * 9/1920 Arbon ..... F16K 39/06 137/584
2013/0008974 A1* 1/2013 Lange ..... B05B 3/003 239/1

FOREIGN PATENT DOCUMENTS

DE 102011078723 A1 1/2013
EP 0426431 B1 4/1994
EP 2543441 A2 1/2013
EP 2556896 A2 2/2013

* cited by examiner

*Primary Examiner* — Rita P Adhlakha
(74) *Attorney, Agent, or Firm* — Whitmyer IP Group LLC

(57) ABSTRACT

A cleaning device including a housing which can be arranged on a feed line for cleaning fluid is disclosed. The housing includes an exit opening for the cleaning fluid, wherein a nozzle head rotatable about a first rotary axis is arranged in the region of the exit opening. A distributing device rotating about a second rotary axis different from the first rotary axis and having at least one blade element or at least one pendulum element is arranged on the rotatable nozzle head. The invention also describes a product-processing plant with at least one cleaning device for cleaning a product tank.

20 Claims, 6 Drawing Sheets

Fig.4
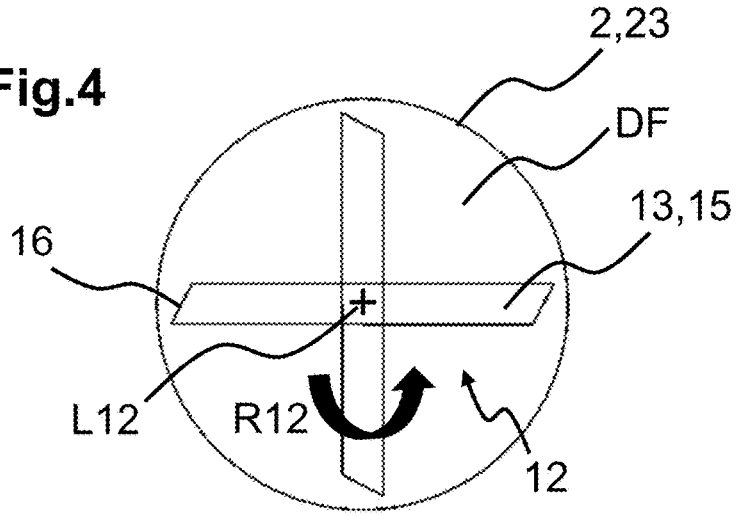
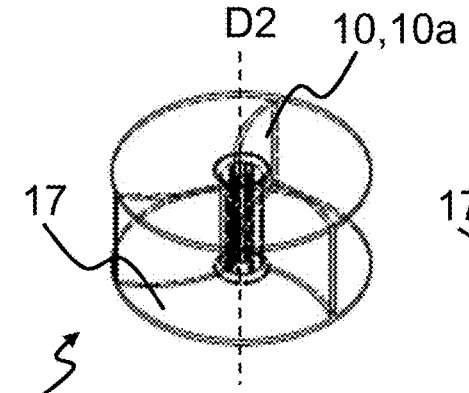
Fig.5A
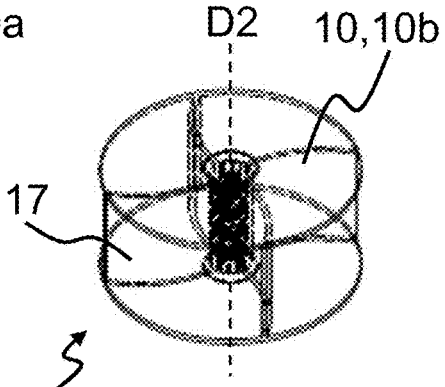
Fig.5B
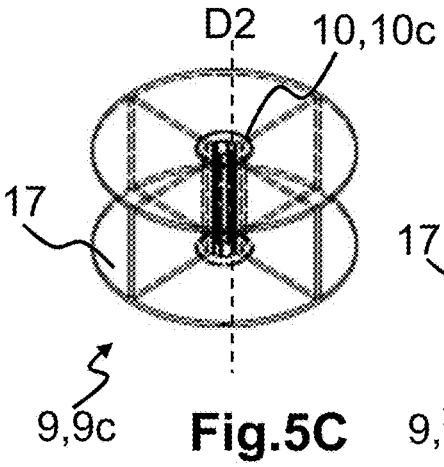
Fig.5C
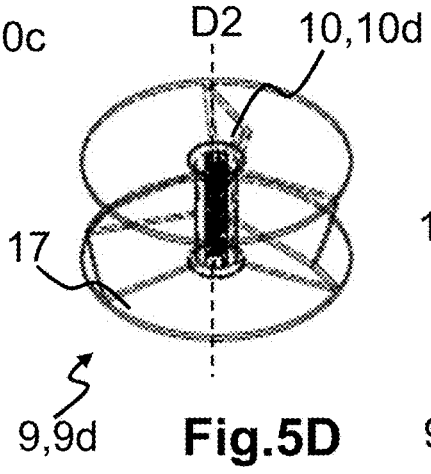
Fig.5D
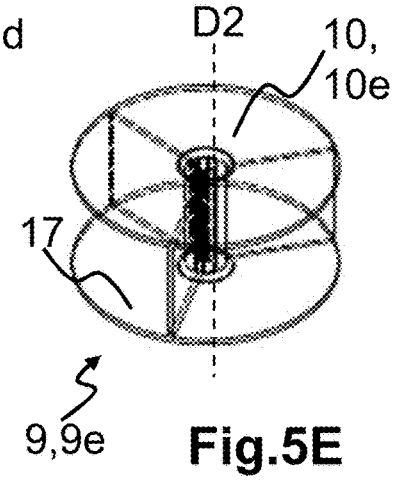
Fig.5E

CLEANING DEVICE AND PRODUCT PROCESSING SYSTEM

TECHNICAL FIELD

The invention relates to a cleaning device for cleaning tanks or suchlike of an industrial, in particular product-processing, plant. Rotating nozzle arrangements for cleaning tanks for example are known, wherein the nozzle head is caused to rotate electrically, hydraulically or pneumatically and thus to distribute the cleaning fluid at least for the most part comprehensively. For example, there are such nozzle arrangements comprising a plurality of individual nozzles which each emit a full jet of cleaning fluid. The individual nozzles are rotated about a rotary axis for example by means of a drive unit in order to cover a large area.

BACKGROUND

Improved nozzle arrangements comprise an additional second rotary axis in order to enlarge the area acted upon and to increase the efficiency of the cleaning.

DE102011078723 A1 describes a rotating nozzle arrangement, wherein the nozzle head rotates about a first rotary axis and wherein exit opening of the rotation axis can be rotated about a second rotary axis which differs from the first rotary axis. By means of the combination of a rotating nozzle head with at least one rotating individual nozzle, an effective action on the treated surface is produced.

EP 2543441 A2 discloses a rotating nozzle arrangement with a first drive unit for rotating the nozzle head about a first rotary axis and with a second drive unit for rotating the nozzle head and the first drive unit about a second rotary axis, wherein the first and the second rotary axis are arranged essentially perpendicular to one another. As a result of superimposing the two different rotary motions, a large coverage can be achieved with a compact structure of the nozzle arrangement.

EP 2556896 A2 describes a tank cleaning nozzle with a shaft rotatable about a first rotary axis and a nozzle head rotatable about a second rotary axis, wherein the first and the second rotary axis are arranged essentially perpendicular to one another. A drive unit for the shaft comprises a turbine wheel, which is connected non-rotatably to the shaft. The turbine wheel and the shaft each comprise a continuous central bore, so that a first flow path passed via the turbine wheel and a second flow path passed via the central bore are provided inside the housing of the tank cleaning nozzle. The speed of the turbine wheel is thus kept low, wherein the torque of the turbine wheel is nonetheless sufficient both to rotate the shaft connected to the turbine wheel about the first rotary axis and also the nozzle head about the second rotary axis.

EP 0426431 B1 discloses spray heads of for tank rinsing devices, which each comprise a flow region, a rotation distributor with a rotation distributor plate, the rotary axis whereof is aligned coaxial with the flow region, and an area of action which lies before the flow region and intersects the rotary axis. Furthermore, helical vane surfaces are arranged on the distributor, which impart to a rotary motion to the distributor upon contact with the liquid flow.

The problem of the invention is to provide an improved cleaning device, in particular a cleaning head, which can also use cleaning fluid which possibly contains, for example due to a cyclical through-flow, fairly coarse components as an impurity.

SUMMARY

The above problem is solved by a cleaning device and a product-processing plant which comprise the features in claims 1 and 16. Further advantageous embodiments are described in the sub-claims The invention relates to a cleaning device, in particular a cleaning head, with which cleaning fluid is applied to surfaces to be cleaned, for example to the internal wall surfaces of tanks to be cleaned or other product containers of a product-processing plant, for example a plant for processing chocolate and/or other confectionery products. The cleaning device is arranged in particular on a feed line for a cleaning fluid. In particular, the cleaning device can be connected detachably or non-detachably to the production container or the feed line or suchlike.

The cleaning device comprises a housing, which is connected to the feed line for the cleaning fluid. The housing is stationary and connected for example rigidly to a flange or suchlike. The housing also comprises an exit opening for the cleaning fluid at an end region lying opposite the feed line. A nozzle head rotatable about a first rotary axis is arranged at the exit opening or at the end region of the housing lying opposite the feed line. The nozzle head has in particular a passage opening constituted for the cleaning fluid. The cleaning device is preferably fastened to the feed line in such a way that the feed line, the exit opening of the housing and the passage opening of the nozzle head are arranged in alignment. A distributing device is arranged on the rotatable nozzle head, which distributing device can rotate about a second rotary axis different from the first rotary axis. The distributing device comprises at least one blade element or at least one pendulum element for the comprehensive distribution of the cleaning fluid.

According to a preferred embodiment of the invention, a guide element is arranged inside the housing between the connection to the feed line and the opposite end region of the housing, which guide element brings about a rotary motion of the cleaning fluid. In particular, the guide element imparts a swirling motion to the cleaning fluid or brings about a vortex formation of the cleaning fluid.

The guide element in particular takes up the dynamic pressure of the supplied, in particular pumped cleaning fluid and transforms the latter into a directed motion of the cleaning fluid.

As a result of the rotation of the cleaning fluid, the nozzle head is caused to rotate relative to the housing, i.e. the guide element serves as a first drive element for a rotary motion of the nozzle head about a first rotary axis.

According to an embodiment of the invention, the guide element can be arranged loosely in the housing. The guide element has an external circumference which is essentially corresponds to the internal circumference of the housing. The guide element is pushed into the intended position by the dynamic pressure of the inflowing cleaning fluid. Alternatively, the guide element can also be fastened to the housing and/or be an integrated component of the housing.

According to an embodiment of the invention, the guide element comprises a plurality of guide means, for example paddles or suchlike, arranged around a longitudinal axis of the guide element, which guide means bring about a desired rotary motion of the cleaning fluid. By means of the guide means, the cleaning fluid has to pass through a specific path. A new rotation direction is thereby imposed on the cleaning fluid. The guided passage along the guide means preferably brings about a rotation of the cleaning fluid. The guide means are laterally adjacent to the internal wall surfaces of the housing, so that in plan view a partially closed area is formed or a partially closed cross-section results. The longitudinal axis of the guide element is in particular coaxial or parallel with the first rotary axis of the distributing device.

The pitch of the guide means with respect to the longitudinal axis of the guide element influences the peripheral speed of the cleaning fluid and can be selected differently depending on the given requirements on the cleaning device. The smaller the pitch of the guide means is constituted, the higher the peripheral speed of the cleaning fluid. Furthermore, the gradient of the guide means also acts on the intensity of the formed vortex.

According to an embodiment of the invention, the guide element is constituted as a spiral element, which comprises at least one complete spiral turn and is laterally adjacent to the internal wall surfaces of the housing, in such a way that in plan view a closed area is formed or a closed cross-section results. The spiral element brings about a targeted guidance of the cleaning fluid inside the housing of the cleaning device. The cleaning fluid is forced to pass through the spiral element completely and in particular without shortcuts. The cleaning fluid is set into a rotary motion, i.e. the spiral element brings about in particular a vortex formation in the cleaning fluid.

The pitch of the spirals of the spiral element influences the peripheral speed of the cleaning fluid and can be selected differently depending on the given requirements made on the cleaning device. The smaller the pitch of the spiral element is constituted, the higher the peripheral speed of the cleaning fluid. Furthermore, the pitch of the spirals also acts on the intensity of the formed vortex.

Furthermore, provision can be made such that the housing, in the region of the exit opening or in the end region lying opposite the feed line, is constituted as a contact face for the nozzle head to be arranged thereon. In particular, the housing in the region of the exit opening comprises an outwardly directed shoulder, which forms a first contact face and the nozzle head comprises a correspondingly formed second contact face. When the nozzle is arranged on the housing, the two contact faces lie one upon the other in such a way that the smallest possible frictional resistance exists between the two contact faces. In particular, the nozzle head is arranged rotatably on the housing by means of the second contact face lying on the first contact face of the housing.

The nozzle head is formed in particular by two half shells. The latter are arranged at the exit opening or at the end region of the housing and are connected to one another in such a way that the second contact face is formed and arranged at the desired position. The nozzle head preferably comprises a fixing opening, with an internal diameter which is slightly larger than the external diameter of the end region above the shoulder, but smaller than the external diameter of the shoulder. In particular, the two half shells form together a fixing opening. Alternatively, the nozzle head can be formed from an upper and a lower half shell, wherein the upper half shell comprises the fixing opening.

According to an embodiment of the invention, the nozzle head is produced including an integrated locator as a connected part. This is made possible for example by means of 3-D printing or other suitable production methods.

The second contact face of the nozzle head can preferably comprise radial slits, in order that any clogging impurities can be released again. The rotation of the nozzle head leads to the formation of centrifugal forces, which act on the impurities and lead to a movement of the impurities directed away from the nozzle head.

Furthermore, provision can be made such that the first contact face and, corresponding thereto, the second contact face are constituted conical in order to centre the rotatable nozzle head on the housing.

The cleaning fluid, which transfers out of the housing into the nozzle head, has an inherent rotation or a vortex and brings about a rotation of the nozzle head about a first rotary axis. The first rotary axis is preferably constituted coaxial with a longitudinal axis or central axis of the housing. Particularly preferably, the exit opening of the housing, the passage opening of the nozzle head and the rotary axis are arranged so as to be aligned coaxially.

In order to bring the nozzle head into a rotary motion, the nozzle head comprises a rotationally movable driver element. The latter is arranged in particular in the region of the exit opening or in the end region of the housing lying opposite the feed line. An alternative embodiment to this comprises a rotationally movable driver element, which is arranged at least in some sections in the region of the exit opening or in the end region of the housing lying opposite the feed line and at least in some sections inside the nozzle head. In particular, the driver element according to the alternative embodiment is thus arranged so as to penetrate the exit opening of the housing.

The vortex or swirling motion of the cleaning fluid generated by the guide element strikes the driver element and brings about a rotation of the driver element. The driver element and the nozzle head are preferably fixedly connected to one another, so that the driver element and the nozzle head rotate at the same speed.

The driver element comprises at least one vane. The at least one vane of the driver element is constituted and arranged in such a way that, with a full rotation of the vane about a rotary axis, which is preferably arranged coaxial with the longitudinal axis of the housing or with the first rotary axis of the nozzle head described above, the vane completely covers or goes round or skims an internal periphery of the housing once. The cleaning fluid set in rotation by the guide element sets the driver element in rotation. It is clear to the person skilled in the art that the at least one vane of the driver element, as a result of a complete rotation about the rotary axis of the driver element, comprehensively skims the internal periphery of the housing. However, at least one minimal gap is provided between the vane and the internal wall surface of the housing, i.e. the driver element is arranged contactless or with a clearance in the housing, so that the driver element can rotate without friction on the housing. The rotary axis of the driver element is constituted in particular coaxial with the longitudinal axis or central axis of the housing and preferably aligned with the exit opening of the housing and the passage opening of the nozzle head.

According to an embodiment of the invention, the driver element comprises four vanes. A greater number of vanes has the advantage that a more uniform motion is thus achieved.

Furthermore, provision can be made such that a defined spacing is constituted between the guide element and the driver element. The spacing between the guide element and the driver element in the vertical plane is in particular crucial for how well the driver element is set in motion. If the spacing between the guide element and the driver element is too small, a pulsating motion arises. Depending on the application, this may also be desirable and used to advantage. That is to say that the invention also comprises embodiments in which the spacing between the driver element and the guide element is intentionally constituted so small that a pulsating motion of the cleaning fluid is generated.

According to a further embodiment of the invention, the outer edges of the side of the driver element facing the inflow are constituted angled-off. The effect of this is that any impurities present in the cleaning fluid are reduced in size at the outer edges.

It is thus possible to make repeated use of cleaning fluid in a cyclical manner, for example to clean tanks or suchlike in production plants for chocolate and/or confectionery mixtures, wherein granulated sugar in particular or other coarse ingredients can contaminate the cleaning fluid.

For example, the driver element is constituted as a cross plate, wherein four arms offset at a 90° angle to one another are arranged on a common rotary axis. The cross plate has a front face that is as small as possible directed towards the housing. The passage area for the cleaning fluid is thus as large as possible. The jamming of impurities between the driver element and the internal wall surface of the housing can thus largely be eliminated.

Furthermore, provision can be made such that the edges of the driver element directed towards the internal wall surfaces of the housing are ground with a bevel. A stripping effect can thus be generated at the internal wall surface of the housing. Clogging of impurities between the driver element and the housing can thus be effectively prevented, which otherwise would lead to jamming of the driver element in the housing.

The driver element can be produced for example as a precision-milled part in the form of a Greek cross with four equally long cross arms. In particular, the driver element can be constituted such that it is arranged with a small clearance with respect to the internal wall of the housing. A driver element with such a cross-shaped cross-section is preferably centred by the vortex of the cleaning fluid itself in the position intended for it.

According to a further embodiment, the driver element can be formed from two laser plates inserted into one another, which in the form inserted together also form the shape of a Greek cross with four equally long cross arms.

Furthermore, the driver element also centres the rotatable nozzle head on the housing. The nozzle head can of coarse also be centred on the housing by the contact face, but coarse impurities could once again get jammed in the narrow gap, for which reason the centring of the nozzle head is advantageously brought about by means of the driver element.

Furthermore, the nozzle head can comprise at least one holding element, at which the distributing device with the blade elements or pendulum elements is mounted rotatably. As a result of the rotation of the nozzle head about a first rotary axis, in particular coaxial with the longitudinal axis or central axis of the housing, the second rotary axis for the rotation of the distributing device is variable in a rotation plane arranged at an angle to the first rotary axis. The rotation plane is preferably constituted largely perpendicular to the first rotary axis. If the nozzle head is rotated relative to the housing of the cleaning device, the position of the least one holding element and therefore also the alignment of the second rotary axis inside the rotation plane are changed.

The cleaning fluid exits from the rotary nozzle head and strikes the distributing device, in particular on the blade elements or pendulum elements of the distributing device. The distributing device is caused to rotate and the cleaning fluid is propelled away from the cleaning device by the blade elements or pendulum elements. Depending on the speed of the cleaning fluid striking the distributing device, high rotation speeds of the distributing device are generated.

As a result of the combined rotation of the nozzle head about a first rotary axis and the distributing device arranged on the nozzle head and jointly rotating with the latter about the first rotary axis of the nozzle head and about an additional second rotary axis, the formation of a spray shadow in particular is avoided, since the cleaning fluid can be spun off over a radius of more than 180° by centrifugal forces.

According to an embodiment of the invention, the rotatable nozzle head has a central axis, which is constituted essentially coaxial with the longitudinal axis or central axis of the housing. The distributing device can be fastened to the holding elements of the nozzle head in such a way that the distributing device is positioned in particular on the central axis of the nozzle head.

According to an alternative embodiment, the distributing device can be fastened to the holding device of the nozzle head in such a way that the distributing device is positioned in particular perpendicularly offset with respect to the central axis of the nozzle head. As a result of this offset, the rotation of the distributing device can advantageously be brought about by the inflow of cleaning fluid from the nozzle head and an optimum distribution of the cleaning fluid on the surfaces to be cleaned by the distributing device can thus be achieved.

The embodiment or geometry, number and/or arrangement of the blade elements on the distributing device has a differing effect on the distribution of the cleaning fluid. There are shapes of blade elements which have to be operated with an offset with respect to the central axis of the nozzle head, whereas others can also deliver the desired result without an offset. The number and embodiment of the blade elements can be selected and optimally matched depending on the requirements made on the cleaning device.

Alternatively, the distributing device can also comprise at least one pendulum element, which is suitable for deflecting cleaning fluid from the cleaning device, so that the latter is sprayed or flung in the direction of the surfaces to be cleaned. In a tilted end position of the pendulum, provision has to be made for load relief, in order that the pendulum can be swung back into an initial position or into a second end position. This could be achieved by interrupting the fluid flow or by partitioning off the fluid flow onto the pendulum.

Furthermore, it may be advantageous to mount the distributing device with clearance, in particular on the at least one holding element of the nozzle head, in order that any adhering impurities to not lead to jamming, but can be released again.

The distributing device can in particularly be constituted as a distributing double-wheel. The two wheels can each preferably be constituted as solid discs, between which the least one blade element or pendulum element of the distributing device is arranged. The solid discs in particular form lateral edges, which bring about a targeted guidance of the cleaning fluid towards the least one blade element or pendulum element. In particular, a concentrated ejection of cleaning fluid is ensured in embodiments of the distributing device with lateral edges.

According to an embodiment of the invention, the housing is constituted cylindrical and has a longitudinal axis. According to another embodiment of the invention, provision is made such that the housing is constituted cylindrical at least in some sections and has a longitudinal axis. At least one internal diameter of the housing is tapered in the direction of the exit opening or the end of region lying opposite the feed line. For example, the housing has a cylindrical shape with an external diameter, wherein the housing, on account of its embodiment, can be divided into three sections in the interior of the housing. The first section mounted on the feed line is constituted hollow-cylindrical and has a first internal cross-sectional area. In a second central section, the internal cross-sectional area tapers in the direction of the exit opening of the housing or in the direction of the end region of the housing lying opposite the feed line, in particular conically tapering. At the boundary with an imaginary third section, the housing has a second internal cross-sectional area, which is smaller than the first internal cross-sectional area. The third section, which extends up to the exit opening, is also constituted hollow-cylindrical, wherein the third internal cross-sectional area corresponds to the second internal cross-sectional area and wherein the cross-sectional area of the exit opening also corresponds to the third internal cross-sectional area.

Alternatively, provision can be made such that the housing is constituted cylindrical at least in some sections and has a longitudinal axis and that the housing tapers conically at least in some sections in the direction of the end region. For example, the housing can be divided into three sections visible from the exterior. The first section mounted at the feed line is constituted hollow-cylindrical and has a first external circumference and a first internal circumference. The second central section is constituted conical and tapers in the direction of the exit opening of the housing or in the direction of the end region of the housing lying opposite the feed line. The second part has, at the boundary with the first part, an external circumference and an internal circumference which correspond to the first external circumference and the first internal circumference. The third section is also constituted hollow-cylindrical and has a third external circumference and a third internal circumference. The second part has, at the boundary with the third part, an external circumference and an internal circumference which correspond to the third external circumference and the third internal circumference.

As a result of the tapering of the internal cross-sectional area in the housing, the speed of the cleaning fluid conveyed through can in particular easily be increased.

According to an embodiment of the invention, provision can be made such that the guide element is constituted corresponding to the tapering of the housing and is arranged in particular in the second section of the housing. For example, a correspondingly constituted guide element is inserted loosely into the funnel-shaped second section and is pushed by the dynamic pressure of the cleaning fluid into the intended position. The additional rotationally movable driver element is arranged in particular in the third section of the housing.

The invention also relates to a product-processing plant with at least one product tank, in which at least one cleaning device is integrated so as to be able to clean said product tank quickly and easily. The at least one cleaning device is arranged on at least one feed line for a cleaning fluid. In particular, the at least one cleaning device is located in an upper region of the product tank and is preferably arranged centrally, so as to be able to cover in an ample fashion all the surfaces of the product tank with cleaning fluid. According to alternative embodiments, the at least one cleaning device can also be arranged centrally at lateral surfaces of the product tank or even in the bottom region, so that an ejection of cleaning fluid takes place upwards. The cleaning conditions, for example the pressure at which the cleaning fluid is introduced etc., must be selected such that a full-area coverage of the surfaces to be cleaned by cleaning fluid is achieved. In particular, in the case of larger product tanks and/or product tanks with internal obstructions, a plurality of cleaning devices are arranged in the upper region and/or in different regions of the product tank in order to prevent spray shadows and thus to ensure comprehensive cleaning.

The cleaning device comprises a housing arranged on the feed line and has an exit opening arranged lying opposite the feed line. A nozzle head rotatable about a first rotary axis is arranged at the exit opening. A distributing device rotating about a second rotary axis different from the first rotary axis and having at least one blade element or at least one pendulum element is arranged on the rotatable nozzle head.

The at least one cleaning device of the product-processing plant preferably comprises the features described above.

An essential advantage of the cleaning device, in particular of the cleaning head, consists in the fact that the latter is designed essentially without constrictions. Coarse impurities of the cleaning fluid, for example sugar crystals or suchlike, can thus pass through the cleaning device without clogging it up. This enables reuse of the cleaning fluid, in particular the cleaning fluid can be conveyed numerous times in a cyclical manner, so that the same cleaning fluid can be used for a number of rinsing procedures and cleaning fluid can thus be saved.

The cleaning device is preferably used for CIP cleaning, i.e. for cleaning inside a product plant (cleaning in place), wherein contaminated cleaning fluid can also preferably be used a number of times.

The cleaning device can be installed at different installation angles without the function being adversely affected. The dynamic pressure of the cleaning fluid ensures the functions of the guide element and the driver element with regard to their influence on the motion of the cleaning fluid inside the cleaning device.

The positioning or rotation of the rotatable nozzle head at the free end of the housing of the cleaning device is brought about on the one hand by the vortex formation of the cleaning fluid by means of the guide element and/or by the rotary motion of the driver element. Furthermore, the positioning or rotation of the rotary nozzle head is also brought about by the pressure of the cleaning fluid on the distributing device arranged on the nozzle head.

No electrically operated drive elements are required to produce the rotary movements of the rotatable nozzle head and/or the driver element and/or the distributing device. The rotation is produced by the dynamic pressure and the guided motion of the cleaning fluid.

After completion of the cleaning, no further cleaning fluid is supplied, i.e. dynamic pressure of the cleaning fluid is absent. Depending on the installation angle of the cleaning device, the cleaning fluid can flow out of the latter essentially without any residue. In the case of unfavourable installation angles, the cleaning fluid can simply be removed from the cleaning device by blowing out the latter with compressed air.

The edges of the driver element at right angles to the flow direction of the cleaning fluid through the housing, on the other hand, act as an additional size-reduction means and in particular bring about a size-reduction of coarse impurities.

The cleaning is possible in a circuit operation with a sufficient quantity of cleaning fluid. The cleaning fluid loaded with contaminating particles, for example with granulated sugar or suchlike, can flow through the cleaning device without this having an adverse effect on the function of the nozzle head. The repeated use of a batch of cleaning fluid, for example liquid cleaning fat for confectionery applications, leads to a marked reduction in the total quantity of cleaning fluid required for the cleaning.

A cleaning cycle lasts for example for approximately 20 minutes, wherein nozzle head 20 rotates up to 60 times. That is to say that the nozzle head rotates once up to three times per minute. The distributing device, on the other hand, rotates much more quickly, in particular at 50 to 5000 revolutions per minute. The combination of a nozzle head rotating slowly about a first rotary axis with a distributing device rotating quickly about a second diverging rotary axis produces particularly good cleaning results, since the spray width and the washing effect increase, as is known, with slowly rotating cleaning heads compared to quickly rotating heads.

BRIEF DESCRIPTION OF THE DRAWINGS

Examples of embodiment are intended to explain the invention and its advantages in greater detail below with the aid of the appended figures. The size ratios of the individual elements with respect to one another in the figures do not always correspond to the actual size ratios, since some forms are represented simplified and other forms are represented enlarged in relation to other elements for the sake of better illustration.

FIG. 4 shows a cross-section through a driver element.

FIGS. 5A to 5H show different embodiments of a distributing device.

DETAILED DESCRIPTION

Identical reference numbers are used for identical or identically acting elements of the invention. Furthermore, for the sake of clarity, only reference numbers that are required for the description of the given figure are represented in the individual figures. The represented embodiments only represent examples as to how the device according to the invention can be constituted and do not represent a conclusive limitation.

Figure 1:
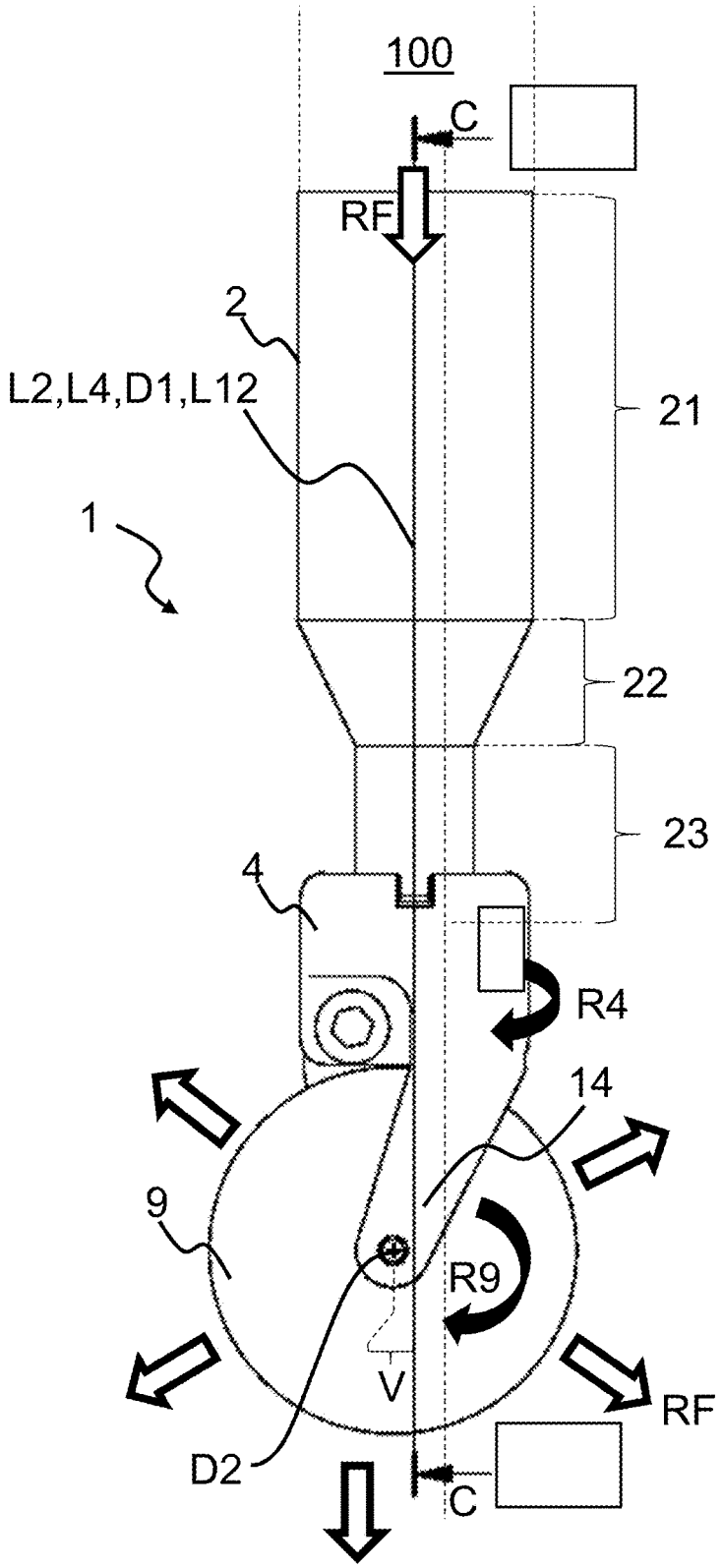
FIG. 1 shows a diagrammatic external view of a cleaning device according to the invention.
Figure 2:
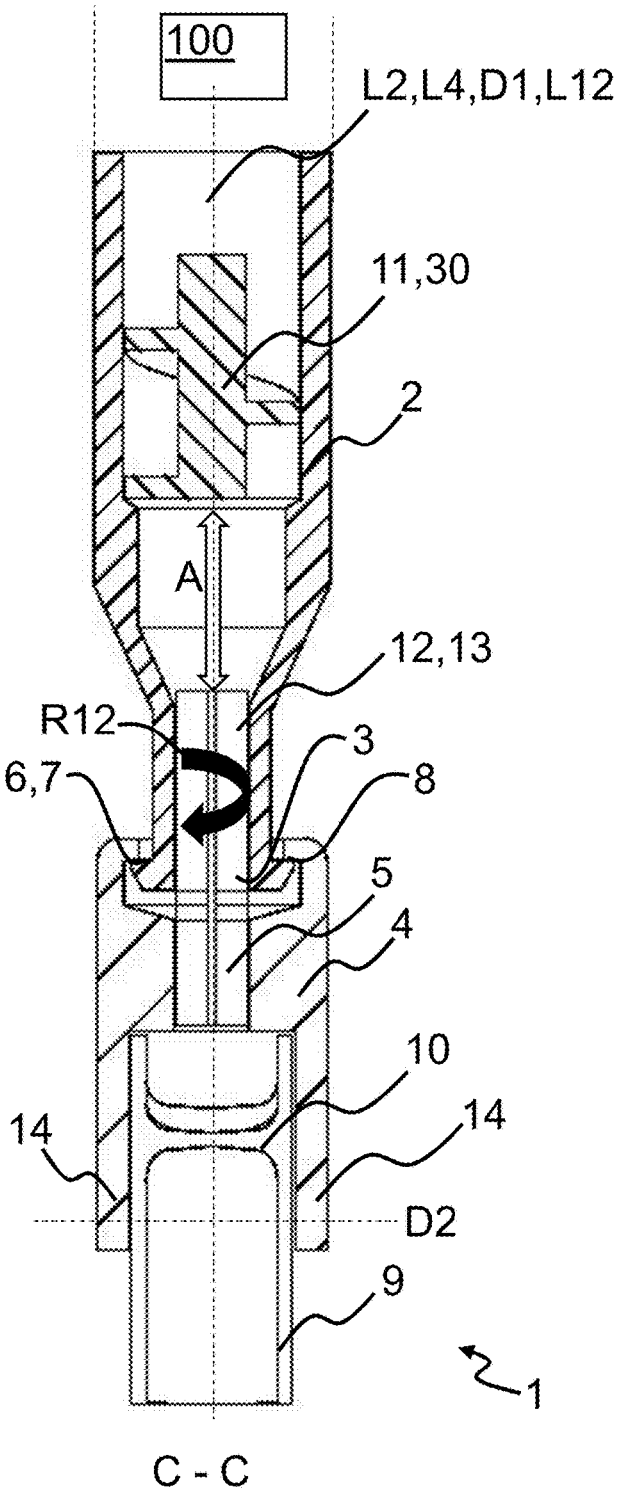
FIG. 2 shows a cross-section along intersection line C-C according to FIG. 1 of a cleaning device according to the invention.
Figure 3:
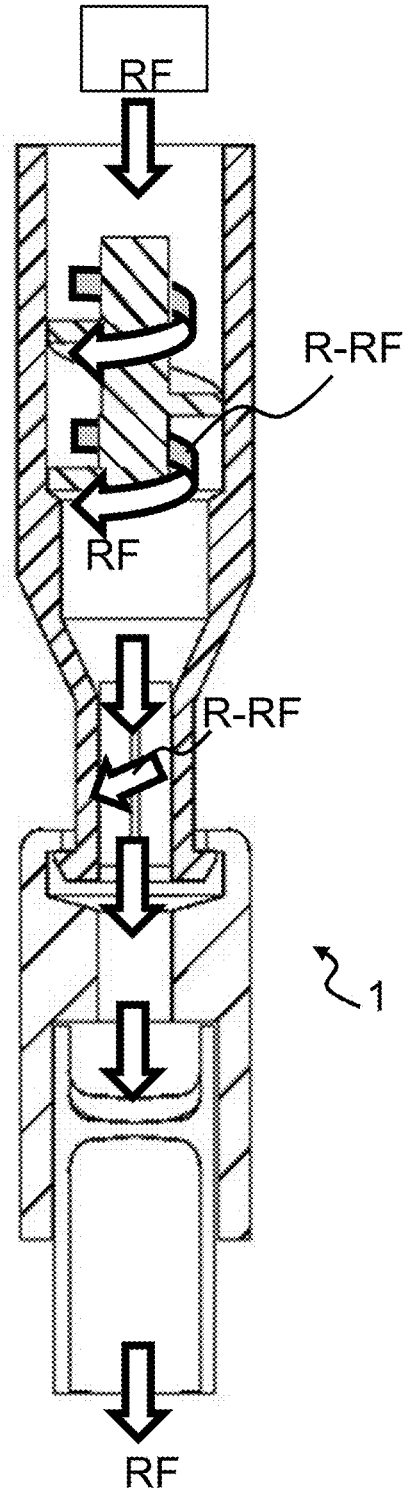
FIG. 3 shows a through-flow of cleaning fluid through a cross-section along intersection line C-C according to FIG. 1 of a cleaning device according to the invention.

FIG. 1 shows a diagrammatic external view of a cleaning device 1 according to the invention and FIG. 2 shows a cross-section along intersection line C-C according to FIG. 1. FIG. 3 shows the through-flow of cleaning fluid through a cleaning device 1. Furthermore, directions are represented in FIG. 1 in which cleaning fluid RF is distributed.

Cleaning device 1 comprises a housing 2. Housing 2 can be fastened detachably or non-detachably to a feed line 100 for a cleaning fluid RF, for example connected by flange or otherwise connected. Since feed line 100 is not a component part of cleaning device 1, the latter is indicated solely by dashed lines. Cleaning fluid RF flows through housing 2. Said cleaning fluid exits from housing 2 via an exit opening 3.

A nozzle head 4 is arranged rotatably on housing 2 at the end region of housing 2 lying opposite feed line 100, i.e. in particular in the region of exit opening 3. In particular, nozzle head 4 forms a passage opening 5 for cleaning fluid RF flowing via exit opening 3 out of housing 2 into nozzle head 4.

In particular, a first contact face 6 on housing 2 is constituted in the region of exit opening 3, for example in the form of a shoulder 7. Nozzle head 4 is formed in particular by two half shell elements, which together constitute a second contact face 8. In particular, second contact face 8 is constituted corresponding to first contact face 6 of housing 2. Nozzle head 4 is arranged on housing 2 in such a way that a contact point with the least possible friction is constituted between first contact face 6 and second contact face 8, so that nozzle head 4 can rotate in rotation direction R4 (see FIG. 1) about a longitudinal axis L2 of housing 2 or a coaxial longitudinal axis L4 of nozzle head 4. Furthermore, the rotary axis of nozzle head 4 is also denoted as first rotary axis D1.

Furthermore, a distributing device 9 with at least one blade element 10 rotating about a second rotary axis D2 different from first rotary axis D1 is arranged on nozzle head 4.

Housing 2 comprises a first cylindrically constituted section 21 for fastening to feed line 100. This is followed by a second conically tapering section 22, which in particular transforms into a third also cylindrically constituted section 23, wherein the diameter in third section 23 is smaller than the diameter in first section 21.

A guide element 11 in the form of a spiral element 30 is arranged in first section 21. Said spiral element comprises at least one complete spiral turn and makes contact comprehensively with the internal wall surfaces of housing 2, so that in plan view a total cross-section of housing 2 in first section 21 is filled by spiral element 30.

According to a further embodiment not represented, the housing is constituted completely hollow-cylindrical. Optionally, provision can be made such that the internal region of the housing comprises structures which divide the housing into specific functional regions. For example, provision can be made such that the tapering described above is constituted in the interior of the cylinder.

As represented in FIGS. 1 and 3, guide element 11 brings about a targeted guidance of cleaning fluid RF inside housing 2, in particular inside first section 21 of cleaning device 1. Cleaning fluid RF is in particular forced to run through guide element 11 constituted as spiral element 30 completely and in particular without shortcuts. Cleaning fluid RF is thus put into a rotary motion R-RF, wherein cleaning fluid RF preferably forms a vortex.

A rotationally movable driver element 12 is also arranged in third section 23, optionally at least partially projecting into second section 22. This driver element 12 has a longitudinal axis L12 coaxial with longitudinal axis L2 of housing 2 or coaxial with longitudinal axis L4 of nozzle head 4. Four blades 13 rotating about longitudinal axis L12 are arranged on this longitudinal axis L12 of driver element 12, in such a way that blades 13, during rotation R12 of driver element 12 about its longitudinal axis L12, do not touch the internal wall surfaces of housing 2 in third section 23, but there is only a small clearance formed.

According to the present embodiment, the driver element projects at least in some sections into nozzle head 4 and is mechanically connected to the latter.

As a result of the rotation of cleaning fluid RF, driver element 12 arranged downstream in the direction of motion of cleaning fluid RF is put into a rotation R12 (see in particular FIG. 1) relative to housing 2. Driver element 12 is coupled mechanically to nozzle head 4 in such a way that rotation R12 of the driver element directly brings about a rotation R4 of nozzle head 4. Guide element 11 thus serves as a first drive element, which brings about rotation R-RF of the cleaning fluid and thus, by a rotation R12 of driver element 12 thus generated, rotation R4 of nozzle head 4.

Cleaning fluid RF exiting from rotating nozzle head 4 strikes the at least one blade element 10 of distributing device 9. A rotation R9 of distributing device 9 about a second rotary axis D2 is thus set in motion, the effect whereof is in particular that cleaning fluid RF is propelled away from cleaning device 1 in all directions.

In the present example of embodiment, guide element 11 is arranged in first section 21 of housing 2. It can however also be arranged in conically tapering second section 22. In particular, provision can be made such that a correspondingly dimensioned guide element (not represented) can be inserted loosely into the conically tapering funnel section of second section 22, which guide element is then pushed by the dynamic pressure of inflowing cleaning fluid RF into the correct position.

It is important here that a defined spacing A is constituted between guide element 11 and driver element 12, in order that driver element 12 is put by cleaning fluid RF into rotation, in particular into rotation R12.

Distributing device 9 is fastened in particular by holding elements 14 directly to nozzle head 4, so that distributing device 9 rotates both about first rotary axis D1 of nozzle head 4 and also about a second rotary axis D2, wherein second rotary axis D2 is variable on account of rotation R4 of nozzle head 4 inside a rotation plane. Whereas rotation R4 of nozzle head 4 takes place relatively slowly, rotation R9 brought about by cleaning fluid RF striking blade elements 10 of distributing device 9 is much quicker. This produces a particularly good distribution of cleaning fluid RF in all directions, wherein in particular a so-called spray shadow, i.e. a region which no cleaning fluid RF reaches, can be avoided.

According to the represented embodiment, distributing device 9 is arranged with a horizontal offset V (see FIG. 1) with respect to longitudinal axis L4 of nozzle head 4, as a result of which the inflow of cleaning fluid RF from nozzle head 4 particularly advantageously brings about rotation R9 of distributing device 9.

FIG. 4 shows a cross-section through a driver element 12 and in particular the arrangement of driver element 12 in section 23 of housing 2.

In particular, driver element 12 has the shape of a Greek cross with four equally long cross arms 15, which form vanes 13 of driver element 12. It can clearly be seen that vanes 13 of driver element 12 each extend approximately up to the internal wall surface of housing 2, but they do not touch it. Driver element 12 can thus rotate freely about its longitudinal axis L12.

Driver element 12 has a front face as small as possible in cross-section, so that passage area DF for cleaning fluid RF (see FIG. 3) is as large as possible. Jamming of impurities of cleaning fluid RF between driver element 12 and the internal wall surface of housing 3 can thus for the most part be prevented.

The outer edges of the front face of driver element 12 facing inflow 100 (see FIGS. 1 and 2) are preferably constituted angled-off and act as size-reduction means for any coarse impurities that may be present in the cleaning fluid.

The edges of vanes 13 of driver element 12 pointing towards the internal wall surfaces of housing 2 have a bevel 16. During rotation R12 of driver element 12, a stripping effect occurs, which prevents the jamming of impurities between driver element 12 and housing 2 of cleaning device 1.

FIGS. 5A to 5H and FIGS. 6A to 6C show different embodiments of a distributing device 9*a* to 9*l*. The embodiment or geometry, number and/or arrangement of blade elements 10 on distributing device 9 has a differing effect on the distribution of the cleaning fluid. There are shapes of blade elements 10 which preferably have to be operated with an offset with respect to longitudinal axis L4 of nozzle head 4 (see FIGS. 1 and 2), whereas others can also deliver the desired result without an offset. The number and embodiment of blade elements 10 can be selected and optimally adapted depending on the requirements made on cleaning device 1.

Distributing devices 9*a* to 9*h* represented in FIG. 5 are each constituted as a distributing double wheel, wherein blade elements 10 are each arranged between two discs 17. The two discs 17 can each preferably be constituted as solid discs. Discs 17 in particular form lateral edges, which bring about a targeted guidance of the cleaning fluid towards blade elements 10.

Figure 5F:
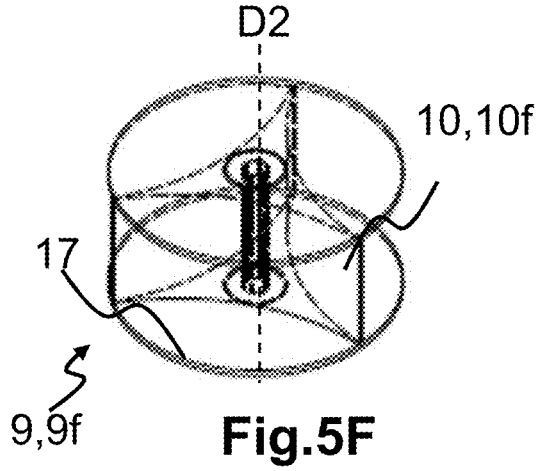
Figure 6A:
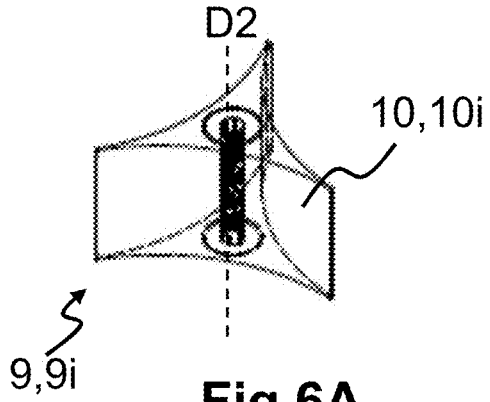
FIGS. 6A to 6C show further embodiments of a distributing device.
Figure 5G:
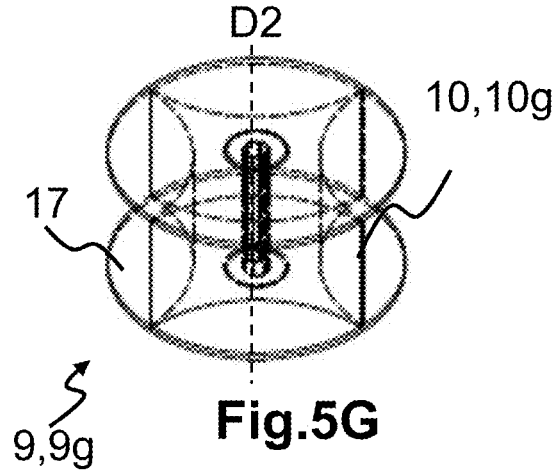
Figure 6B:
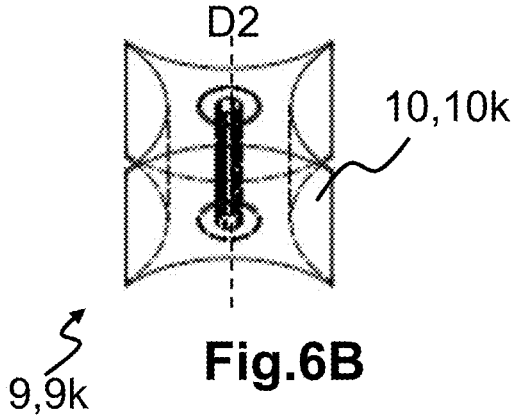
Figure 5H:
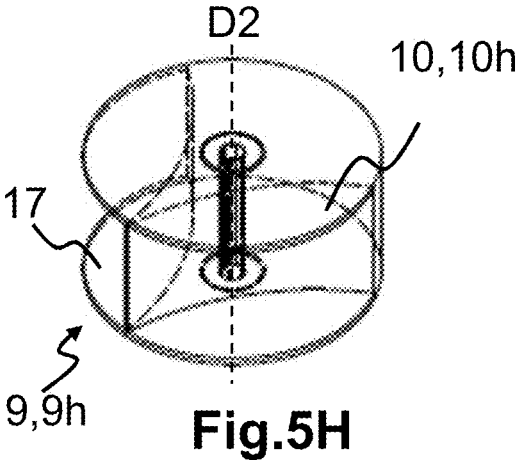
Figure 6C:
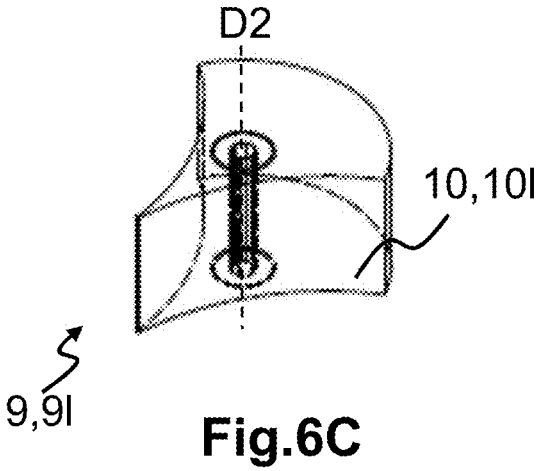

Blade elements 10*a*, 10*b* according to FIGS. 5A and 5B are constituted as curved vanes, whereas blade elements 10*c* to 10*e* according to FIGS. 5C to 5E are constituted as planar or plane vanes. FIGS. 5F to 5H show further distributing devices 9*f* to 9*h* with blade elements 10*f* to 10*h* constituted concave with respect to rotary axis D2. Distributing devices 9*i* to 9*l* according to FIGS. 6A to 6*c* are constituted analogous thereto, no discs 17 (see FIG. 5) being provided in these embodiments.

Figure 7A:
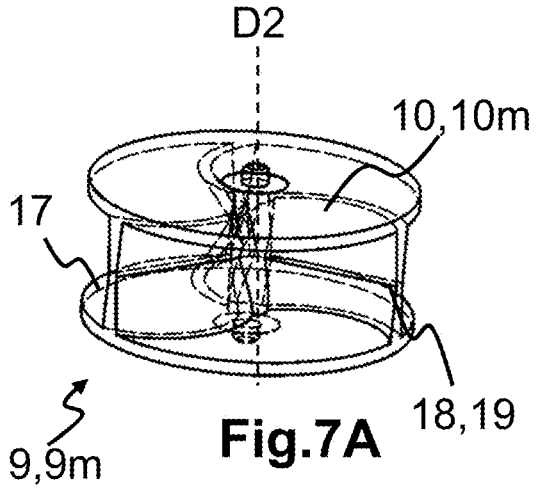
FIGS. 7A and 7B show a further embodiment of a distributing device.
Figure 7B:
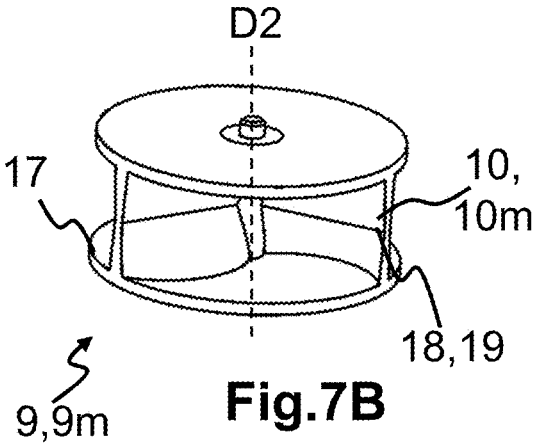
Figure 8A:
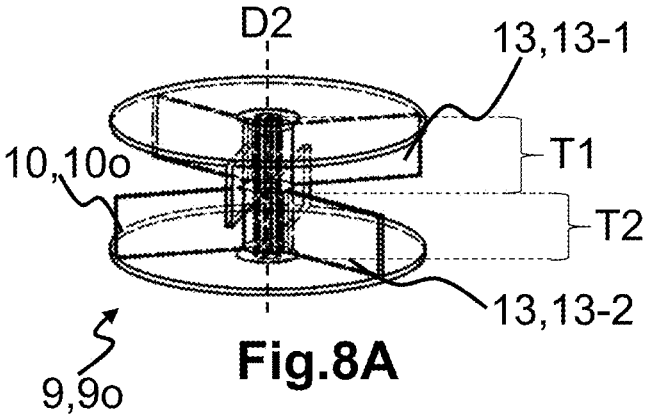
FIGS. 8A and 8B show a further embodiment of a distributing device.
Figure 8B:
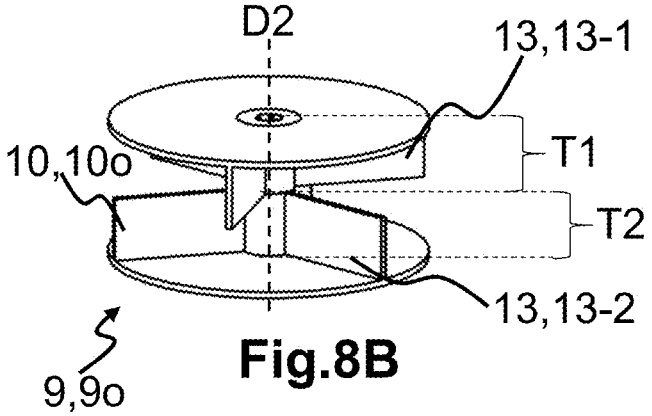

FIGS. 7A and 7B as well as FIGS. 8A and 8B each show a further embodiment of a distributing device 9*m*, 9*o*. FIGS. 7A and 8A show the respective embodiment of distributing device 9*m*, 90 in a representation with hidden lines and FIGS. 7B and 8B show the respective embodiment of distributing device 9*m*, 90 in a representation without hidden lines.

In the case of distributing device 9*m* according to FIG. 7, blade elements 10*m* are constituted as curved vanes, wherein the vanes do not have a uniform thickness. Instead, the vane width tapers in such a way that the vanes have a smallest width roughly in the middle between discs 17, in particular the vanes in this region have a sharp kink 18 or an edge 19, which brings about a changed spin-off behaviour of the cleaning fluid, which can be advantageous under certain conditions.

In the case of distributing device 90 according to FIG. 8, blade elements 10*o* are constituted as plane vanes 13, wherein vanes 13 each extend only to about halfway between the two discs 17. In particular, provision is made such that the region between the two discs 17 is divided into two sub-regions T1 and T2. Three vanes 13-1 extending perpendicular to rotary axis D2 are arranged in first sub-region T1, which vanes are each offset with respect to one another by an angle of 120 degrees. Three vanes 13-2 extending perpendicular to rotary axis D2 are also arranged in second sub-region T2, which vanes are also each offset with respect to one another by an angle of 120 degrees.

Furthermore, provision is made such that vanes 13-1 in first sub-region T1 are arranged offset by an angle of 60 degrees with respect to vanes 13-2 in second sub-region T2. This split embodiment of vanes 13 also brings about a changed spin-off behaviour of the cleaning fluid, which can be advantageous for certain applications.

Figure 9A:
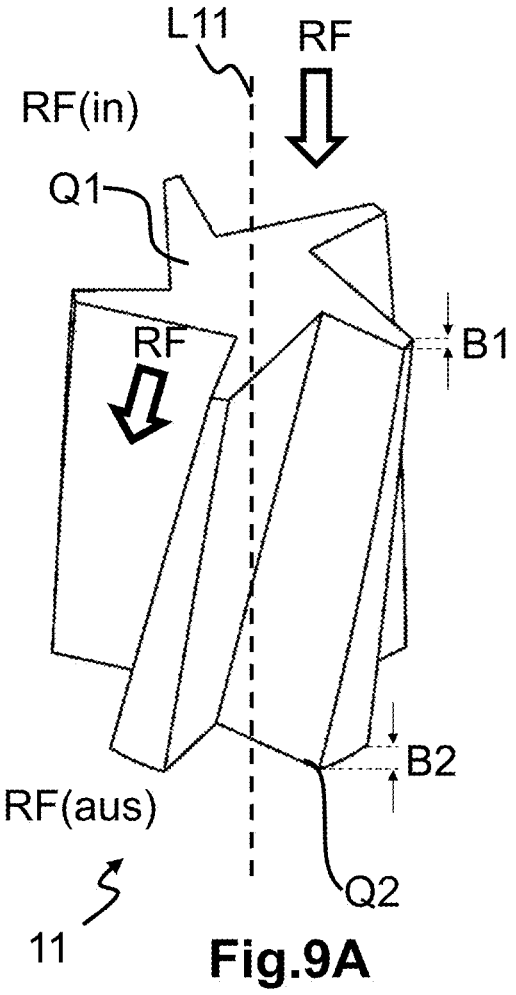
FIGS. 9A to 9D show a further embodiment of a guide element.
Figure 9D:
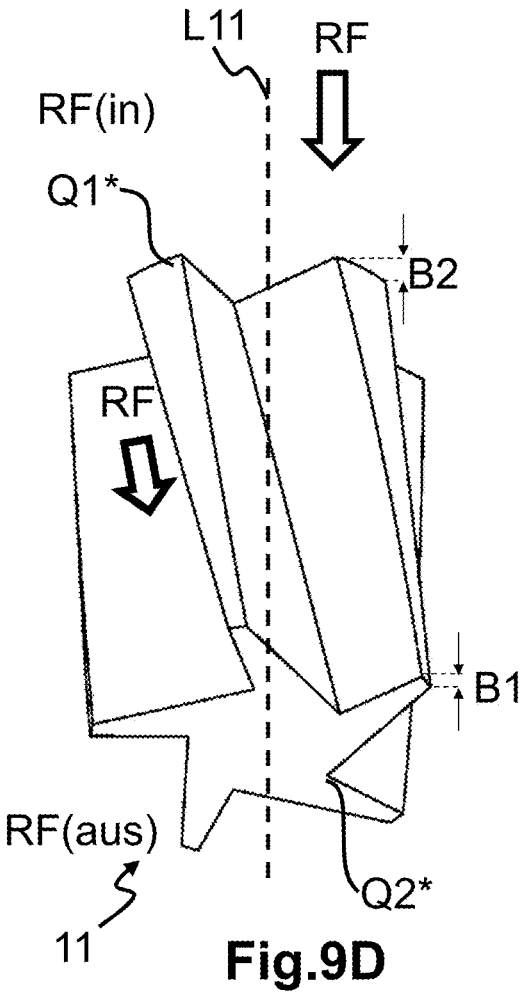
Figure 9B:
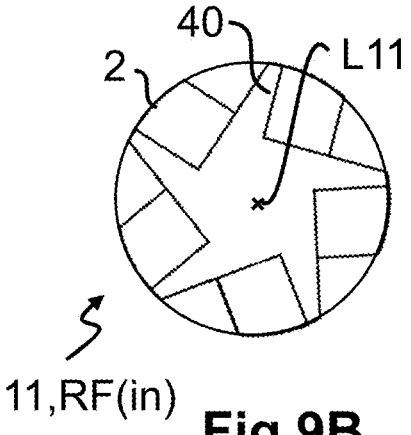
Figure 9C:
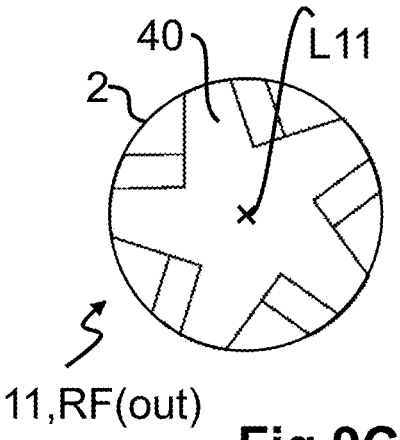

FIGS. 9A to 9D show a further embodiment of a guide element 11, in particular FIG. 9A shows a lateral representation of guide element 11, FIG. 9B shows a plan view of a guide element 11 according to FIG. 9A from above and FIG. 9C shows a plan view of a guide element 11 according to FIG. 9A from below. FIG. 9D shows a guide element 11 arranged inverted.

Guide element 11 has a longitudinal axis L11, which in particular is aligned coaxial or parallel to the first rotary axis of distributing device 9 (see FIGS. 1 to 3).

Guide element 11 comprises five paddles 40 arranged about longitudinal axis L11 of guide element 11. Guide element 11 comprises an entry side RF(in) and an exit side (out) for cleaning fluid RF. Cleaning fluid RF enters via entry side RF(in) into guide element 11, runs through the latter thereby at least partially changing the direction of motion and/or the speed of motion, exits via exit side RF(out) from guide element 11 and then strikes driver element 12.

Paddles 40 are set at an angle to longitudinal axis L11 of guide element 11. The pitch of paddles 40 with respect to longitudinal axis L11 of guide element 11 influences the peripheral speed of cleaning fluid RF. The smaller the pitch of paddles 40 is constituted, the higher the peripheral speed of cleaning fluid RF at exit side RF(out). In particular, the pitch of the paddles 40 also has an effect on the intensity of the formed vortex of cleaning fluid RF.

Paddles 40 of guide element 11 lie laterally adjacent to the internal wall surfaces of housing 2, so that a partially closed area is formed, or a partially closed cross-section results, on account of the angular setting of paddles 40 with respect to longitudinal axis L11 of guide element 11 in the plan view of entry side RF(in).

According to the represented embodiment, the width of paddles 40 in the cross-sectional plane perpendicular to longitudinal axis L11 of guide element 11 increases from entry side RF(in) in the direction of exit side RF(out). On account of a first width B1, a first cross-section Q1 in particular results at entry side RF(in), which is smaller than a second cross-section Q2 at exit side RF(out) resulting due to an increased width B2. A guide element 11, which can be used in different ways, results due to the different widths B1 and B2. As a result of a transposition or rotation of guide element 11 in housing 2 of cleaning device 1 (see FIGS. 2 and 3), a changed pitch of the guide means or paddles 40 results between entry side RF (in) and exit side RF (out).

FIG. 9D shows the arrangement of a guide element 11 rotated in housing 2 (not represented). With this arrangement, the width of paddles 40 in the cross-sectional plane perpendicular to longitudinal axis L11 of guide element 11 diminishes from entry side RF(in) in the direction of exit side RF(out). On account of first width B1, a cross-section Q2* now results at exit side RF(out), which is smaller than a cross-section Q1* at entry side RF(in) resulting due to increased width B2.

Depending on the arrangement of guide element 11 inside housing 2 of cleaning device 1 (see FIGS. 2 and 3), a vortex of differing intensity can thus be generated.

Further embodiments known to the person skilled in the art, which can put the cleaning fluid into a swirling motion, are also intended to be covered by the invention.

The invention has been described by reference to a preferred embodiment. A person skilled in the art can however imagine that modifications or changes to the invention can be made without thereby departing from the scope of protection of the following claims.

The invention claimed is:

1. A cleaning device comprising;

a housing with an internal cross-sectional area which can be arranged on a feed line for cleaning fluid and having an exit opening arranged lying opposite the feed line;

a nozzle head rotatable about a first rotary axis arranged at the exit opening;

a distributing device with a lateral surface area rotating about a second rotary axis different from the first rotary axis and having at least one blade element or at least one pendulum element arranged on the rotatable nozzle head;

where the lateral surface area of the distributing device is greater than the internal cross-sectional area of the housing.

2. The cleaning device according to claim 1, wherein a guide element is arranged inside the housing between the feed line and the exit opening, wherein a rotary motion of the cleaning fluid can be brought about by the guide element.

3. The cleaning device according to claim 2, wherein the guide element is arranged loose in the housing or wherein the guide element is fastened to the housing.

4. The cleaning device according to claim 3, wherein the first rotary axis is constituted coaxial with a longitudinal axis of the housing and wherein the distributing device can be rotated about at least one second rotary axis, which lies in a plane arranged for the most part perpendicular to the longitudinal axis of the housing.

5. The cleaning device according to claim 4, wherein the nozzle head has a central axis, which is constituted essentially coaxial with the longitudinal axis of the housing and wherein the distributing device is positioned on the central axis of the nozzle head or wherein the distributing device is positioned perpendicularly offset with respect to the central axis of the nozzle head.

6. The cleaning device according to claim 2, wherein the housing in the region of the exit opening includes a first contact face for the nozzle head.

7. The cleaning device according to claim 1, wherein the housing in the region of the exit opening includes a first contact face for the nozzle head.

8. The cleaning device according to claim 7, wherein the nozzle head includes a second contact face, which is constituted corresponding to first contact face in the region of the exit opening and wherein the nozzle head is arranged lying rotatably on housing by means of the second contact face on the first contact face.

9. The cleaning device according to claim 1, wherein the nozzle head is formed from two half shells.

10. The cleaning device according to claim 9, wherein the driver element has a cross-shaped cross-section, in particular in the form of a cross with four equally long cross arms.

11. The cleaning device according to claim 1, wherein the cleaning device includes a rotationally movable driver element in the region of the exit opening of the housing or wherein the cleaning device includes a rotationally movable driver element which is arranged at least in some sections in the region of the exit opening of the housing and at least in some sections inside the nozzle head.

12. The cleaning device according to claim 11, wherein the driver element includes at least one vane, in particular wherein the driver element includes four vanes.

13. The cleaning device according to claim 12, wherein a defined spacing is constituted between the guide element and the driver element.

14. The cleaning device according to claim 11, wherein a defined spacing is constituted between the guide element and the driver element.

15. The cleaning device according to claim 11, wherein outer edges on a side of the driver element facing the guide element are constituted angled-off.

16. The cleaning device according to claim 1, wherein the rotatable nozzle head includes at least one holding element, at which the distributing device with the at least one blade element or pendulum element is mounted rotatably.

17. The cleaning device according to claim 1, wherein the housing is constituted cylindrical at least in some sections and has a longitudinal axis, wherein at least one internal diameter of the housing tapers in the direction of the exit opening.

18. The cleaning device according to claim 1, wherein the housing is constituted cylindrical at least in some sections and has a longitudinal axis and wherein the housing tapers conically at least in some sections in the direction of the exit opening.

19. The product-processing plant with at least one product tank with at least one integrated cleaning device according to claim 1.

20. A product-processing plant with at least one product tank with at least one integrated cleaning device for cleaning the product tank with a cleaning fluid which can be supplied via a feed line, the cleaning device including:

a housing with an internal cross-sectional area arranged on the feed line and having an exit opening arranged lying opposite the feed line;

a nozzle head rotatable about a first rotary axis is arranged at the exit opening;

a distributing device with a lateral surface area rotating about a second rotary axis different from the first rotary axis and having at least one blade element or at least one pendulum element arranged on the rotatable nozzle head, where the lateral surface area of the distributing device is greater than the internal cross-sectional area of the housing.

* * * * *